US005893491A

United States Patent [19]

Brody

[11] Patent Number: 5,893,491

[45] Date of Patent: Apr. 13, 1999

[54] SQUEEZE BOTTLE DISPENSER WITH IMPROVED CLOSURE AND SPRING-ACTION EXTENSIBLE DISPENSING TUBE

[75] Inventor: Harvey Brody, Costa Mesa, Calif.

[73] Assignee: Norvey, Inc., Santa Ana, Calif.

[21] Appl. No.: 08/990,564

[22] Filed: Dec. 15, 1997

[51] Int. Cl.[6] ..... B67D 3/00; B67D 5/60; B65D 37/00

[52] U.S. Cl. ..... 222/530; 222/211; 222/464.3; 222/529

[58] Field of Search ..... 222/211, 464.3, 222/464.5, 529, 530

[56] References Cited

U.S. PATENT DOCUMENTS

| | | | |
|---|---|---|---|
| D. 200,364 | 2/1965 | Brody | D58/26 |
| 2,805,001 | 9/1957 | Biederman | 222/211 |
| 3,100,068 | 8/1963 | Kersten | 222/207 |
| 3,127,064 | 3/1964 | Fairchild | 222/153 |
| 3,181,745 | 5/1965 | Grobowski | 222/530 |
| 3,291,331 | 12/1966 | Grisham et al. | 222/529 |
| 3,482,739 | 12/1969 | Laas | 222/529 |
| 4,461,406 | 7/1984 | Vannucci | 222/530 |
| 4,462,544 | 7/1984 | Rutzel et al. | 239/33 |
| 4,726,491 | 2/1988 | Moon | 222/529 |
| 4,781,573 | 11/1988 | Depreter | 425/577 |
| 4,911,315 | 3/1990 | Shrum | 215/229 |
| 4,925,128 | 5/1990 | Brody | 222/211 |
| 5,048,705 | 9/1991 | Lynd et al. | 215/1 A |
| 5,388,712 | 2/1995 | Brody | 215/229 |

*Primary Examiner*—Andres Kashnikow
*Assistant Examiner*—Keats Quinalty
*Attorney, Agent, or Firm*—Klein & Szekeres, LLP

[57] ABSTRACT

A squeeze bottle dispenser includes a squeezable container, a cap with a tubular nipple defining a central passage, and an extensible dispensing tube extending from the interior of the container through the passage, the tube having an outer end terminating in a dispensing orifice. The tube is movable between retracted and extended positions, and it is spring-biased toward its extended position when it is in its retracted position. A removable closure is sealingly engageable with both the outer end of the tube and the nipple, so as to seal both the passage and the dispensing orifice when the tube is in its retracted position, and the dispensing orifice separately when the tube is in its extended position. When the tube is in its retracted position, its inner end is pushed against an internal surface of the container, thereby causing it to bow. It is retained in this bowed configuration by the simultaneous engagement of the closure with both the outer end of the tube and the nipple. The bowing of the resilient tube causes it to store potential energy much as a spring, so that, when the closure is disengaged from the nipple, the tube straightens out, causing its outer end to be pushed further out of the passage. The closure, still engaged with the outer end of the tube, is used to pull the tube to its extended position.

5 Claims, 2 Drawing Sheets

10
12
14
16
18
20
22
26
28
34
36
38
40
4
5

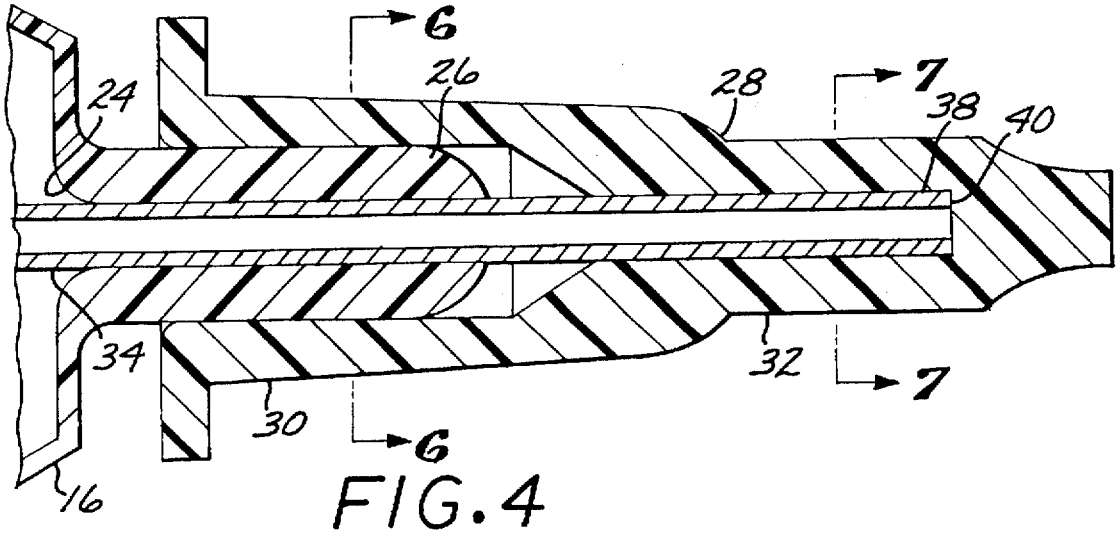
FIG. 4
FIG. 5
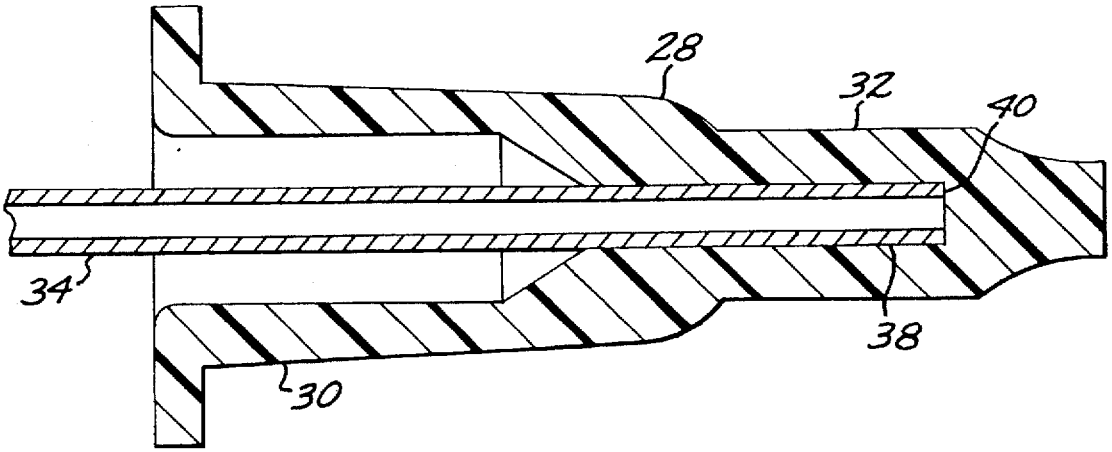
FIG. 6
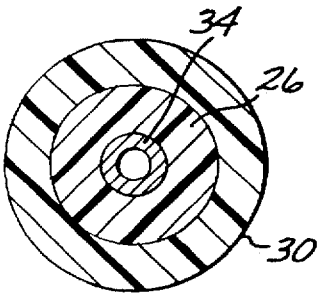
FIG. 7
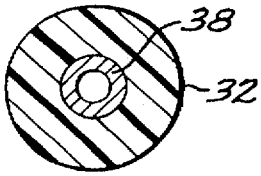

SQUEEZE BOTTLE DISPENSER WITH IMPROVED CLOSURE AND SPRING-ACTION EXTENSIBLE DISPENSING TUBE

CROSS REFERENCE TO RELATED APPLICATION

Not Applicable

FEDERALLY FUNDED RESEARCH OR DEVELOPMENT

Not Applicable

BACKGROUND OF THE INVENTION

The present invention relates generally to the field of containers for dispensing liquids, of the type commonly known as "squeeze bottles". More particularly, this invention relates to improvements in squeeze bottles having extensible dispensing tubes.

Squeeze bottles are very well known and come in a variety of configurations for many different applications. One particular type of squeeze bottle has become quite popular for dispensing lubricating oils and the like. This type of squeeze bottle has a cap or top, preferably removable, with a central aperture. A long, hollow, flexible dispensing tube is retained in the bottle with just its outer end portion normally exposed through the aperture. When it is desired to dispense the contents of the bottle, the tube is extended through the aperture to form an elongate, flexible dispensing conduit, thereby allowing the contents of the bottle to be dispensed into small orifices and relatively inaccessible places. Typically, a small, removable closure is provided for sealing the outer end of the tube when the bottle is not in use. Examples of squeeze bottles of this general type are disclosed in U.S. Pat. No. 5,388,712; U.S. Pat. No. 4,925,128; and U.S. Design Pat. No. Des. 200,364.

In the typical prior art squeeze bottle, the closure sealingly engages only the outer end portion of the dispensing tube. This sometimes results in the closure being inadequately secured to the bottle. Also, in the typical prior art squeeze bottle, the act of extending the dispensing tube may require some dexterity and effort, in that its exposed outer end must be firmly grasped and the tube pulled out against the frictional forces imposed by the material surrounding the cap aperture.

It would therefore be an advancement in the state of the art in the field of extensible-tube squeeze bottles to have a closure that provides a secure sealing relationship with both the tube and the cap, and to have an extensible dispensing tube that is more easily extensible than has heretofore been possible.

SUMMARY OF THE INVENTION

Broadly, the present invention is an improved squeeze bottle dispenser, of the type including a squeezable container, a cap with a central passage, and an extensible dispensing tube extending from the interior of the container through the passage, the tube having an outer end terminating in a dispensing orifice, the tube being movable between a retracted position and an extended position, wherein the improvement comprises a dispensing tube that is spring-biased toward its extended position when it is in its retracted position. The improvement further comprises a removable closure that sealingly engages both the outer end portion of the tube and the cap, so as to seal both the passage and the dispensing orifice when the tube is in its retracted position, and the dispensing orifice separately when the tube is in its extended position.

More specifically, in a preferred embodiment, the dispensing tube of the present invention is formed as a thin cannula of a resilient metal or plastic. The cap includes a distally-extending tubular nipple, the interior of which defines the passage. When the tube is in its fully retracted position, its inner end is pushed against an internal surface of the container, thereby causing the tube to bow. It is retained in this bowed configuration by the simultaneous engagement of the closure with both the outer end portion of the tube and with the nipple. The bowing of the resilient tube causes it to store potential energy much as a spring, so that, when the closure is disengaged from the nipple, the tube straightens out, causing its outer end to be pushed further out of the passage. The closure, still engaged with the outer end of the tube, is used to pull the tube to its extended position. When it is desired to dispense the contents of the bottle, the closure is removed from the outer end of the tube.

To accomplish the dual sealing function of the closure with both the cap and the outer end portion of the tube, the closure has a graduated inside diameter. That is, it has a proximal portion with a first inside diameter approximately equal to the outside diameter of the nipple, and a distal portion with a second inside diameter approximately equal to the outside diameter of the tube.

As will be appreciated from the detailed description that follows, the closure of the present invention provides effective sealing with both the dispensing tube and the nipple. This provides, in turn, a secure retention of the closure, as well as an effective sealing against possible leaks between the outside surface of the tube and the interior nipple surface surrounding the passage. Furthermore, the cooperation between the closure, on the one hand, and the outer end portion of the tube and the nipple, on the other hand, provides the spring action of the tube that facilitates its movement from the retracted position to the extended position.

BRIEF DESCRIPTION OF THE DRAWINGS

FIG. 4 is a cross-sectional view taken along line 4—4 of FIG. 1;

FIG. 5 is a cross-sectional view taken along line 5—5 of FIG. 2;

FIG. 6 is a cross-sectional view taken along line 6—6 of FIG. 4; and FIG. 7 is cross-sectional view taken along line 7—7 of FIG. 4.

DETAILED DESCRIPTION OF A PREFERRED EMBODIMENT

Figures 1, 2, 3:
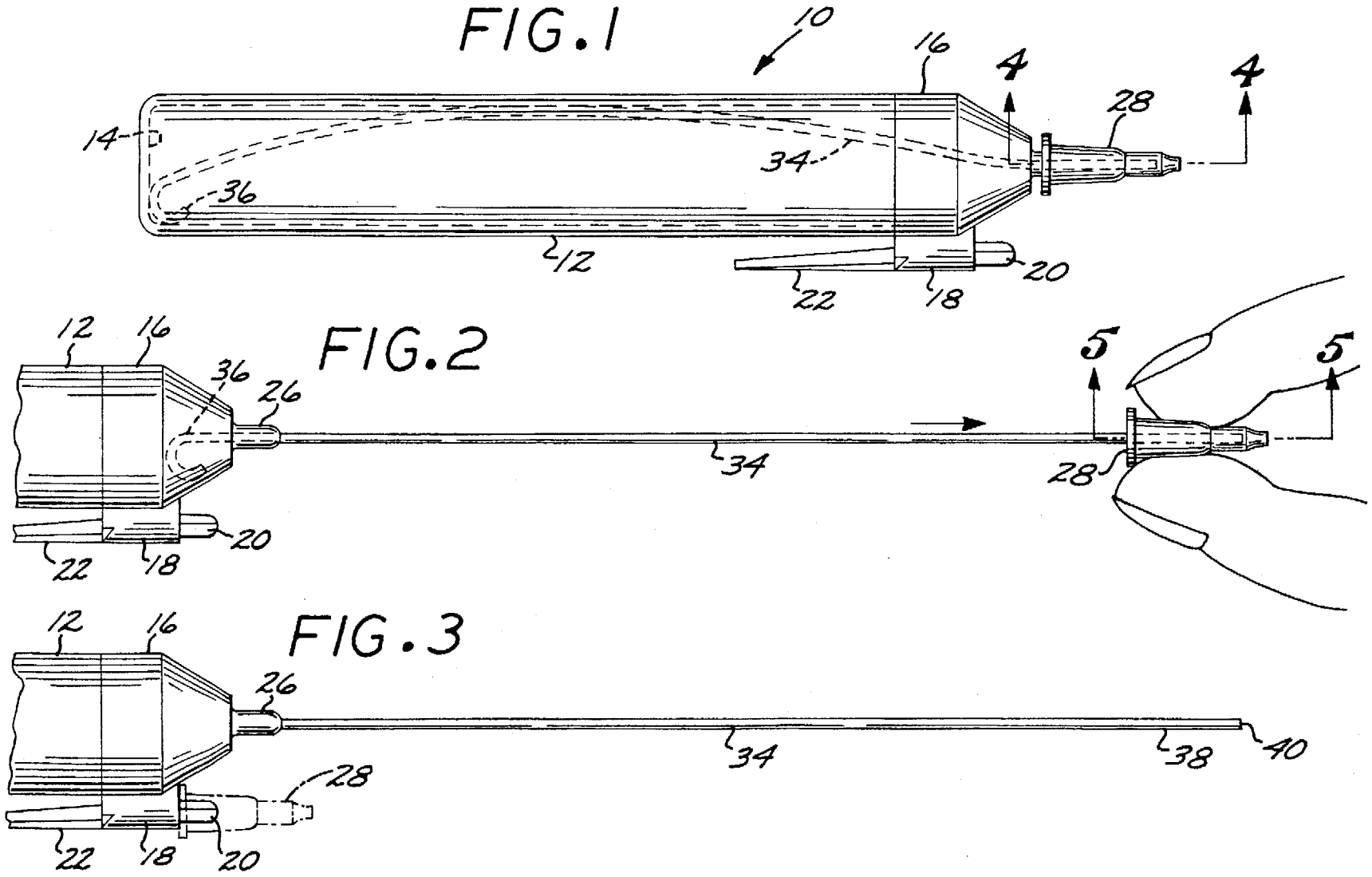
FIG. 1 is an elevational view of a dispensing container in accordance with a preferred embodiment of the present invention, showing its dispensing tube in its retracted position.
FIG. 2 is a partial elevational view of the dispensing container of the present invention, showing the dispensing tube being pulled to its extended position.
FIG. 3 is an elevational view similar to that of FIG. 2, but showing the dispensing tube fully in its extended position, with the closure removed.

Referring now to the drawings, a squeeze bottle dispenser 10, in accordance with a preferred embodiment of the present invention, includes squeezable container 12 of resilient plastic that, when squeezed, returns to its original shape (assuming substantially equalized air pressure in its interior and on its exterior). One end of the container 12 is formed as a substantially flat surface 14, which, as a matter of convention, may be called the "bottom" (although the orientation is arbitrary). The other end of the container 12 (which may by convention be termed the "top") is terminated by a cap 16, which is preferably removable from the container 12 to allow refilling, but need not be. (In the drawings, the "top" is on the right in FIGS. 1 through 5, and the "bottom" is on the left.) A projection 18 extends radially from the cap 16. A short plug 20, the purpose of which will be described below, advantageously extends upwardly from the radial projection 18. If the dispenser 10 is dimensioned to be carried in a shirt pocket, a pocket clip 22 may extend downward from the radial projection 18.

The top end of the cap 16 has a frustoconical configuration with a central passage 24 (FIG. 4) that extends through the hollow interior of an upwardly-extending, tubular nipple 26 having an open distal end. The open distal end of the nipple 26, which may be defined as the distal end of the cap passage 24, is selectively closed by a removable closure 28. As best shown in FIGS. 4 and 5, the closure 28 has a proximal portion 30 with an open end, and a distal portion 32 terminating in a closed tip. The proximal portion 30 has a first inside diameter that is approximately equal to the outside diameter of the nipple 26, so that a sealing engagement can be effected therebetween to provide a fluid tight closure of the distal end of the cap passage 24 around the nipple 26.

A dispensing tube 34 is provided in the container 10. The dispensing tube 34 comprises a cannula made of a resilient material, preferably a metal, such as stainless steel, although a suitable plastic may be acceptable. The tube 34 has a curved or hooked inner end portion 36 that has an inner end opening (not shown). The tube 34 has an outer end portion 38 that extends through the cap passage 24 through the length of the nipple 26, and that terminates in an outer end opening 40 (FIGS. 4 and 5). As shown in FIGS. 4 and 5, the outside diameter of the tube 34 is approximately equal to the diameter of the cap passage 24, so that the interior surface of the nipple 26 acts as a frictional bearing surface for the tube 34 as the tube 34 is moved between its retracted position and its extended position, as explained below. The total axial length of the straight part of the tube (i.e., from the outer end opening 40 to beginning of the curvature of the inner end portion 36) is somewhat greater than the distance from the interior surface of the bottle bottom 14 to the distal end of the nipple 26, so that, when the inner end portion 36 of the tube abuts against the interior surface of the bottle bottom 14, the outer end portion 38 of the tube extends a short distance outwardly ("upwardly", in our adopted convention) from the nipple 26.

The distal portion 32 of the closure 28 has an inside diameter that is approximately equal to the outside diameter of the tube 34. Thus, the outer end opening 40 of the tube 34 may be selectively closed by the closure 28 when the outer end portion 38 of the tube 34 is inserted into the closure 28.

As shown in FIGS. 4 through 7, the closure 28 can be deployed either to effect a sealing engagement only with the outer end portion 38 tube 34 (FIG. 5), or to effect a simultaneous sealing engagement with both the outer end portion 38 of the tube 34 and the nipple 26 (FIG. 4). This result obtains from the graduated inside diameters of the proximal and distal portions 30, 32, respectively, of the closure 28 as described. As explained above, the length of the tube 34 is such that its outer end portion 38 extends outwardly from the nipple 26 when the inner end 36 of the tube 34 abuts against the interior surface of the bottle bottom 14. The amount of this extension is such that the closure cannot effect a sealing engagement with both the tube 34 and the nipple 26 without pushing the tube 34 inwardly into the bottle 12. When the tube 34 is thus pushed inwardly, it bows, as shown in phantom in FIG. 1. In the bowed configuration, the resilient tube 34 is under tension, and it therefore stores potential energy much as a spring does. The frictional engagement between the closure 28 and the nipple 26 is sufficient to retain the tube 34 in the bowed configuration, which is the fully retracted position of the tube 34. In the bowed configuration, the tube 34 is under a spring tension that biases it toward its extended position, but it is restrained from movement by the frictional engagement between the closure 28 and the nipple 26.

When the closure 28 is disengaged from the nipple 26, the tension in the tube is released, so that the tube resiliently straightens out, thereby pushing its outer end portion 38 farther outwardly ("upwardly") through the nipple 26, toward the extended position of the tube 34. The closure 28, still engaged with the outer end portion 38 of the tube 34, can then be easily grasped to pull the tube 34 to its extended position, as shown in FIG. 2. The closure 28 fits onto the outer end portion 38 of the tube 34 with a fit that is sufficiently tight that the closure 28 will not be separated from the tube 34 when the closure is grasped and pulled outwardly, as shown in FIG. 2.

Finally, as shown in FIG. 3, the closure 28 can be removed from the tube 34 when it is desired to dispense the contents of the bottle 12 through the tube 34. Removal of the closure 28 from the tube 34 is facilitated by the abutment of the hooked inner end portion 36 of the tube 34 against the interior surface of the cap 16. This abutment defines the limit of the outward movement of the tube 34, thereby representing the fully extended position of the tube 34. With the tube 34 restrained from further outward movement, the closure 28 can easily be separated from it. For convenient storage of the closure 28 while the contents are being dispensed, the closure 28 can be placed on the plug 20. The plug 20 has an outside diameter that is approximately equal to the inside diameter of the proximal portion 30 of the closure 28, so that the closure 28 is frictionally held on the plug 20.

It will be appreciated that the present invention includes a closure that provides an effective seal with both the dispensing tube and the nipple 26, thereby providing both secure retention of the closure 28 and a fluid-tight seal between the dispensing tube 34 and the nipple 34, thereby effectively sealing the passage 24. In addition, the spring action of the dispensing tube 34, provided by above-described structure, facilitates the movement of the tube 34 from its retracted position to its extended position.

While a preferred embodiment of the invention has been described herein, it will be appreciated that a number of variations and modifications will suggest themselves to those skilled in the pertinent arts. For example, the configurations of the cap 16 and the nipple 26 described herein are exemplary only, and may be varied to suit different configurations, uses, and applications of the dispenser 10. Likewise, equivalent structures to the hooked inner end 36 of the tube 34 may be utilized. For example, the inner end portion of the tube 34 may be formed with an enlarged diameter that is larger than the diameter of the passage 24, so that the enlarged end cannot pass through the passage. These and other variations and modifications of the preferred embodiment disclosed herein are equivalents to the analogous structure described above and illustrated in the drawings, and should be considered within the spirit and scope of the invention, as defined in the claims that follow.

What is claimed is:

1. An improved squeeze bottle dispenser, of the type including a squeezable container, a container cap including a distally-extending nipple having a central passage communicating with the interior of the container, the nipple having a distal end opening defining a distal opening of the passage, wherein the improvement comprises:

an extensible dispensing tube extending from the interior of the container through the passage, the tube having an outer end terminating in a dispensing orifice, the tube being movable between a retracted position and an extended position, wherein the tube has a first outside diameter and the nipple has a second outside diameter larger than the first outside diameter;

a removable closure that is sealingly engageable with both the outer end portion of the tube and the nipple, so as to seal both the passage and the dispensing orifice when the tube is in its retracted position, and the dispensing orifice separately when the tube is in its extended position, wherein the closure includes a proximal end opening, a distal portion having a first inside diameter approximately equal to the first outside diameter, and a proximal portion between the proximal end opening and the distal portion and having a second inside diameter approximately equal to the second outside diameter.

2. The dispenser of claim 1, wherein the tube is spring-biased toward its extended position when it is in its retracted position.

3. The dispenser of claim 1, wherein the tube is maintained in its retracted position under tension by the engagement of the closure with the tube and the nipple.

4. The dispenser of claims 1, 2 or 3, wherein the container has a closed end remote from the cap, and wherein the tube has an inner end portion that abuts against the closed end when the tube is in its retracted position, the inner end portion of the tube being configured so as to be unable to enter the passage.

5. The dispenser of claims 1, 2, or 3, wherein the nipple has an interior surface surrounding the passage that forms a bearing surface for the tube.

* * * * *